US008281529B2

(12) United States Patent
Cluff

(10) Patent No.: US 8,281,529 B2
(45) Date of Patent: Oct. 9, 2012

(54) INTERLOCKING BUILDING STRUCTURE

(76) Inventor: Jacob Cluff, Fredonia, AZ (US)

( * ) Notice: Subject to any disclaimer, the term of this patent is extended or adjusted under 35 U.S.C. 154(b) by 0 days.

(21) Appl. No.: 12/939,927

(22) Filed: Nov. 4, 2010

(65) Prior Publication Data

US 2011/0099936 A1 May 5, 2011

Related U.S. Application Data

(60) Provisional application No. 61/258,469, filed on Nov. 5, 2009.

(51) Int. Cl.
*E04B 1/00* (2006.01)
*E04B 5/00* (2006.01)
*E04B 7/00* (2006.01)

(52) U.S. Cl. ..... 52/271; 52/93.1; 52/284; 52/589.1; 52/592.2; 52/653.1; 52/655.1

(58) Field of Classification Search ..... 52/93.1, 52/270, 271, 284, 592.1, 592.2, 653.1, 655.1, 52/92.1, 93.2, 589.1; 403/230, 333, 339, 403/340, 364
See application file for complete search history.

(56) References Cited

U.S. PATENT DOCUMENTS 637,212 A * 11/1899 McCune ..... 52/284
730,150 A * 6/1903 Pfahl ..... 138/157
907,554 A * 12/1908 Ansbach ..... 52/93.1
1,357,626 A * 11/1920 Een ..... 52/284
1,459,761 A * 6/1923 Andrews ..... 52/92.1
1,652,612 A * 12/1927 Daniels ..... 403/364
2,473,018 A * 6/1949 Edwards ..... 52/284
3,162,278 A * 12/1964 Rasch ..... 52/93.1
3,206,903 A * 9/1965 Johnson ..... 52/92.1
3,236,014 A * 2/1966 Norman ..... 52/270
3,397,496 A * 8/1968 Sohns ..... 52/286
3,774,362 A * 11/1973 Matuschek et al. ..... 52/206
3,800,494 A * 4/1974 Hall et al. ..... 403/331
3,828,496 A * 8/1974 Testaguzza et al. ..... 52/91.2
3,902,291 A * 9/1975 Zucht ..... 52/284
3,943,672 A * 3/1976 O'Sheeran ..... 52/73
4,280,307 A * 7/1981 Griffin ..... 52/92.1
4,527,370 A * 7/1985 Schuette ..... 52/282.3
4,584,805 A * 4/1986 Meiry ..... 52/264
4,765,103 A * 8/1988 Clarke ..... 52/86
4,797,020 A * 1/1989 Winston ..... 403/231
4,873,797 A * 10/1989 Rydeen ..... 52/93.1
5,036,634 A * 8/1991 Lessard et al. ..... 52/79.1
5,072,554 A * 12/1991 Hayman ..... 52/79.1
5,170,600 A * 12/1992 Terrell ..... 52/91.1
5,193,931 A * 3/1993 Arato ..... 403/231
5,293,725 A * 3/1994 Matticks et al. ..... 52/271
5,469,678 A * 11/1995 Zamerovsky ..... 52/263
(Continued)

*Primary Examiner* — Brian Glessner
*Assistant Examiner* — Adriana Figueroa
(74) *Attorney, Agent, or Firm* — Morriss O'Bryant Compagni, PC

(57) ABSTRACT

A building structure having a plurality of frame assemblies joined together to form an internal frame structure for a building. Each of the frame assemblies includes a truss, a pair of vertical wall members and a floor joist. The truss is attached to respective top ends the vertical wall members at each end of the truss with interlocking joints in which the truss and vertical wall members are in substantially the same plane. Each vertical wall member is attached to the floor joist with interlocking joints. Each interlocking joint has a puzzle-piece configuration. Cross-members interconnect the frame assemblies in a spaced-apart manner. A floor panel is attached to the floor joists and exterior wall panels are attached to an exterior of the internal frame structure.

17 Claims, 20 Drawing Sheets

U.S. PATENT DOCUMENTS 5,501,043 A * 3/1996 Park ..... 52/92.1
5,581,961 A * 12/1996 Nanayakkara ..... 52/93.2
5,642,594 A * 7/1997 Sucre F ..... 52/270
5,827,006 A * 10/1998 Hoshino ..... 403/340
6,014,842 A * 1/2000 Matsubara ..... 52/79.12
6,311,447 B1 * 11/2001 Lindal ..... 52/590.2
6,470,632 B1 * 10/2002 Smith ..... 52/92.2
6,701,678 B1 * 3/2004 Skov et al. ..... 52/79.9
7,581,357 B2 * 9/2009 Richardson et al. ..... 52/79.5
2002/0178669 A1 * 12/2002 Harambasic et al. ..... 52/264
2004/0187400 A1 * 9/2004 Anderson et al. ..... 52/79.1
2005/0279034 A1 * 12/2005 Tsang ..... 52/79.1
2005/0284039 A1 * 12/2005 Bouverat ..... 52/91.3
2008/0184651 A1 * 8/2008 Bowman ..... 52/645
2010/0325989 A1 * 12/2010 Leahy ..... 52/270

* cited by examiner

INTERLOCKING BUILDING STRUCTURE

CROSS-REFERENCE TO RELATED APPLICATION

The present application claims priority to U.S. Provisional Application Ser. No. 61/258,469, filed on Nov. 5, 2009, the entirety of which is incorporated by this reference.

BACKGROUND

1. Field of the Invention

The present invention relates generally to free standing building structures, and more specifically to a building structure that utilizes interlocking pieces to reduce material waste and to improve structural strength.

2. State of the Art

Most free-standing wood frame building structures, such as outdoor storage sheds, employ conventional wood frame construction techniques in which wood members, such as 2×4 planks are nailed or screwed together to form a floor, walls, roof and door when combined with plywood or wafer board sheets. Such construction generally requires the cutting of lumber to various sizes according to plan, assembly of the individual frame pieces to form frame components, the formation of a floor, the creation of walls, the addition of a roof and the construction and addition of a door. Each step in the such conventional building construction is labor intensive and requires many hours to complete Such outdoor storage sheds, commonly referred to as "sheds on skids", have several advantages in their construction.

1. Sheds on skids are portable.
2. Sheds on skids are considered temporary structures and don't require building permits.
3. Sheds on skids do not necessarily require a concrete pad to pour or tear up if you decide to move the shed.
4. Sheds on skids are easy to move from location to location.
5. Sheds on skids may be lifted onto tractor trailer truck or with crane to move.
6. Sheds on skids may be pre-built or preassembled off-site.
7. Sheds on skids are less expensive to build and site.

Sheds on skids built using conventional construction techniques, however, are more likely to be out of true or plumb resulting in jammed windows and doors, are time consuming and labor intensive to build and result in substantial material waste when constructed.

Thus, it would be advantageous to provide a method and apparatus for forming a building structure, such as a shed, that utilizes building techniques that reduce material waste, reduce construction time and labor and provides a strong, self-supporting structure that is substantially true and plumb when finished.

SUMMARY OF THE INVENTION

Accordingly, the present invention overcomes many of the deficiencies and disadvantages of prior art wood frame building construction by providing interlocking building components and a unique method of construction that provides, when finished, a building that is relatively easy to assemble, results in little material waste and that provides a strong, self-supporting structure that is substantially true and plumb when completed. The present invention utilizes a novel puzzle-piece construction in order to join the various frame components resulting in strong joints and dimensionally accurate construction.

The foregoing advantages and characterizing features will become apparent from the following description of certain illustrative embodiments of the invention. The above-described features and advantages of the present invention, as well as additional features and advantages, will be set forth or will become more fully apparent in the detailed description that follows and in the appended claims. The novel features which are considered characteristic of this invention are set forth in the attached claims. Furthermore, the features and advantages of the present invention may be learned by the practice of the invention, or will be obvious to one skilled in the art from the description, as set forth hereinafter.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION OF THE ILLUSTRATED EMBODIMENTS

Those of ordinary skill in the art will realize that the following description of the present invention is illustrative only and not in any way limiting. Other embodiments of the invention will readily suggest themselves to such skilled persons.

Figure 1:
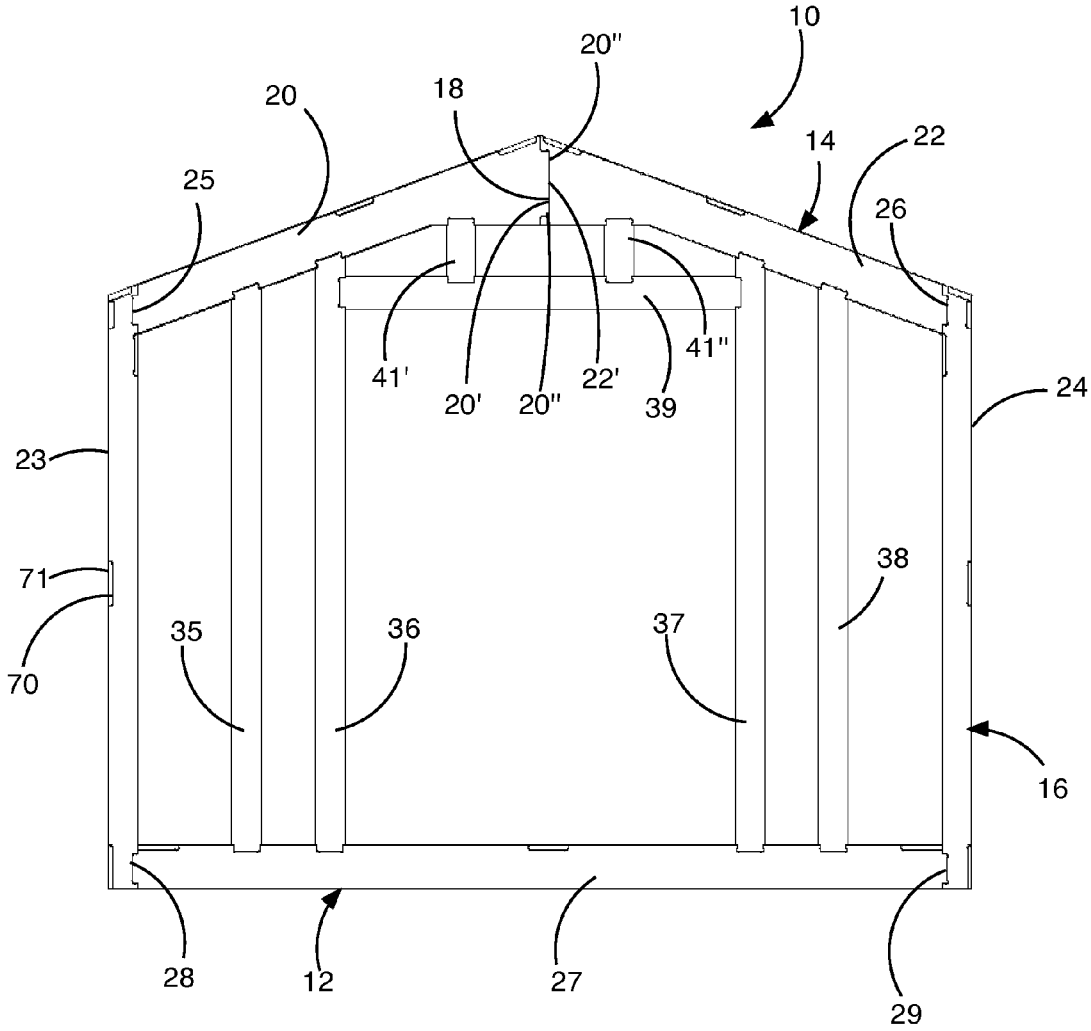
FIG. 1 is a front view of a building frame in accordance with the principles of the present invention.

FIG. 1 illustrates a front view of a door side of a building frame, generally indicated at 10, in accordance with the principles of the preset invention. The frame 10 is comprised of a floor assembly 12, a roof assembly 14 and a plurality of wall assemblies, with front wall assembly 16 being visible. Each of the assemblies 12, 14 and 16 are comprised of a plurality of elongate members that are joined in an interlocking manner to secure adjacent members to one another. As will be described in more detail, the joints between adjacent members, such as joint 18 formed between members 20 and 22, have a jigsaw, puzzle-piece configuration. Specifically, the member 20 is provided with a protruding portion 20' that is received in a recess 22' formed in the member 22. The protruding portion 20' includes radiused ends 20" and 20' that extend laterally beyond the lateral ends of the protruding portion 20'. The recess 22' is configured to substantially match the shape and size of the protruding portion 20' and the remainder of the adjoining edge of the member 20 so as to form a friction fit therewith. In order to allow such members and their respective protruding portions and recesses to properly mate with other adjoining members, the puzzle-piece protrusions and recesses may be formed by CNC milling or other methods in the art that can reproduce such components within tight tolerances (e.g., +/−0.01 inches or greater). The interlocking nature of the components ensures a strong resulting structure that is substantially plumb in all directions to eliminate gaps in construction and to ensure that all of the pieces properly fit together during the course of construction.

The frame assembly 10 illustrated in FIG. 1 is comprised of interlocking roof truss members 20 and 22 that lie in substantially the same plane as defined by their front faces and are interconnected with the jigsaw joint 18. The distal ends of the roof truss members are interconnected by jigsaw joints 25 and 26 with upright wall frame members 23 and 24, respectively. The bottoms of the upright frame members 23 and 24 are interconnected with floor joist 27 by jigsaw joints 28 and 29, respectively. All of these frame members 20, 22, 23, 24 and 27 lie in substantially the same plane. Because frame assembly 10 is configured for a front wall and for mounting of a door (as shown and described herein), additional structural frame members 35, 36, 37 and 38 are provided to attach to and interlock with the truss members 20 and 22 at a respective upper end and with the floor joist 27 at a lower end. Supporting cross-member 39 forms the top of the door frame and is interlockingly attached to the members 36 and 37. Additional vertical support members 41' and 41" extend between the trusses 20 and 22 and the cross-member 39 to provide additional strength to the door frame.

Each frame member 20, 22, 23, 24 and 27 are provided with notches, such as notch 70 on their inside and/or outside lateral sides. The notches 70 are provided to receive horizontal structural members, such as member 71, that are attached to the respective support member, such as member 23. The horizontal structural members 71 span and are attached to adjacent frame assemblies as will be described in further detail.

Figure 2:
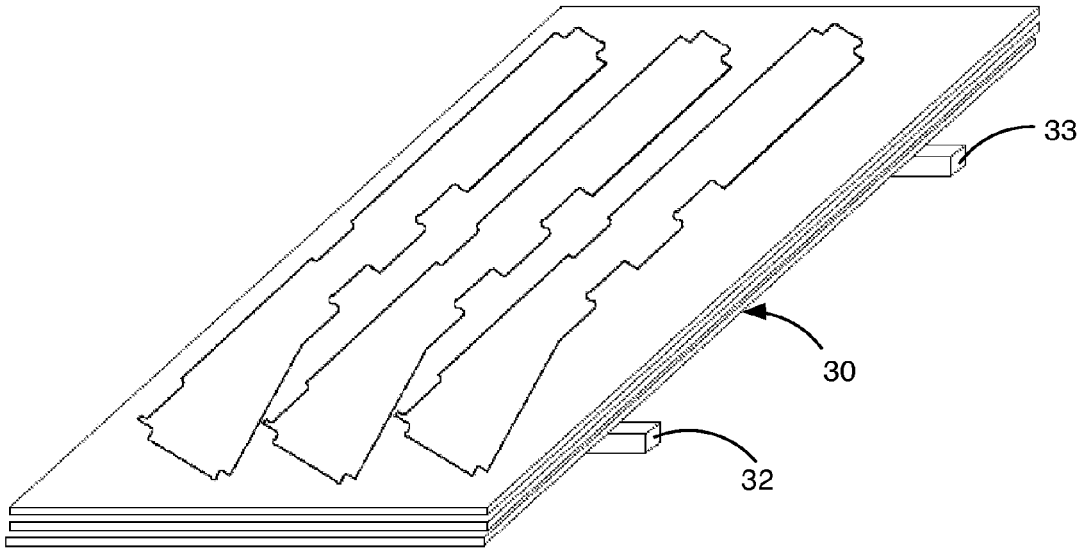
FIG. 2 is a perspective side view of a plurality of building pieces arranged so as to form a shipping pallet in accordance with the principles of the present invention.

As shown in FIG. 2, all of the various pieces needed for construction of a storage shed are provided on a single pallet 30. In this example, the pieces are formed from plywood, but could be formed from other materials such as metal, other wood or wood-based products or plastic. Interestingly, the pallet 30 itself is used as part of the construction to form the floor of the shed. The only pieces not used in the construction of the shed are two end pieces (not shown) that protect the ends of the pallet materials during shipping and the two skid members 32 and 33 that allow the pallet 30 to be lifted with a forklift. All of the components are pre-cut at the factory using cutting and milling techniques known in the art, such as CNC milling so that the components are ready for assembly without the need for on-site cutting. The components are labeled to identify their proper place in the assembly process and are unstacked from the pallet 30 to begin the assembly process. Because all of the components that form a single building structure are contained in a single pallet 30 and the various components of the pallet 30 are almost all used in the construction of a building, the amount of product waste that is otherwise associated with such construction projects is significantly if not completely eliminated. Moreover, because the components are interlocking as previously described, there is less material required to construct a building resulting in lower shipping weight of the pallet 30 as compared to conventional building structures of similar dimension.

Figure 3:
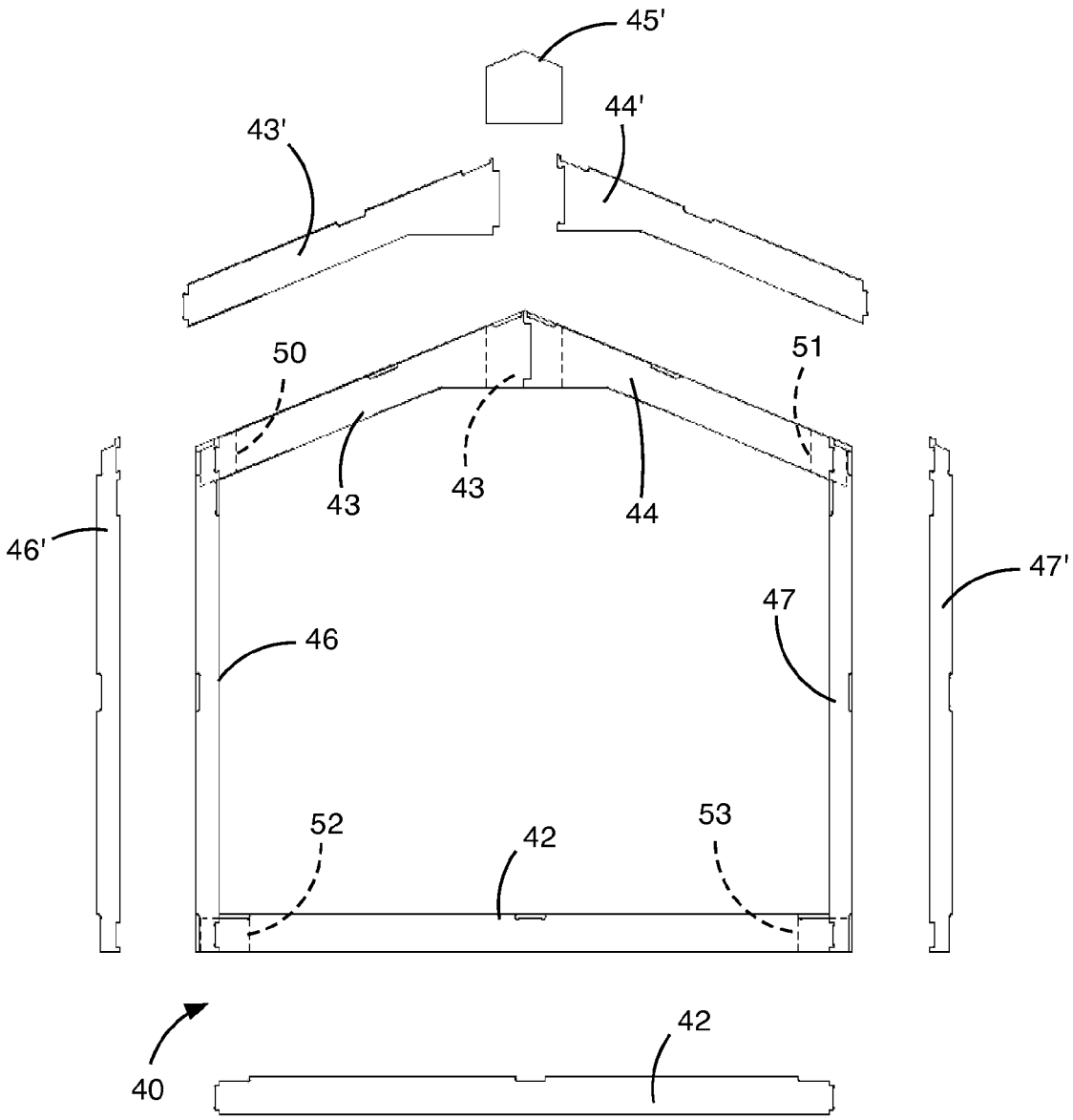
FIG. 3 is a front view of a plurality of building pieces arranged so as to form a frame assembly a building in accordance with the principles of the present invention.

As shown in FIG. 3, to begin assembly, the various base, top and side members 42', 43', 44', 45, 46' and 47' are stacked proximate to an assembly sight so that each subassembly can be assembled in order. An intermediate wall assembly 40 is comprised of a plurality of interlocking members including a base member 42, top members 43, 44 and 45, upright side members 46 and 47. For additional lateral stability of each subframe assembly 40, each interlocking joint may be covered with overlapping support members 45, 50, 51, 52 and 53. These overlapping members may be comprised of wood, steel, aluminum or other materials known in the art and are attached to the frame assembly 40 over each interlocking joint. When using wood, each support member 45, 50, 51, 52 and 53 may be attached with a plurality of brads, staples, nails or screws. The support members 45, 50, 51, 52 and 53 are provided at locations where more lateral strength in the construction is required or desired. Such overlapping members can be attached using a nail gun or by other means known in the art.

Figure 4:
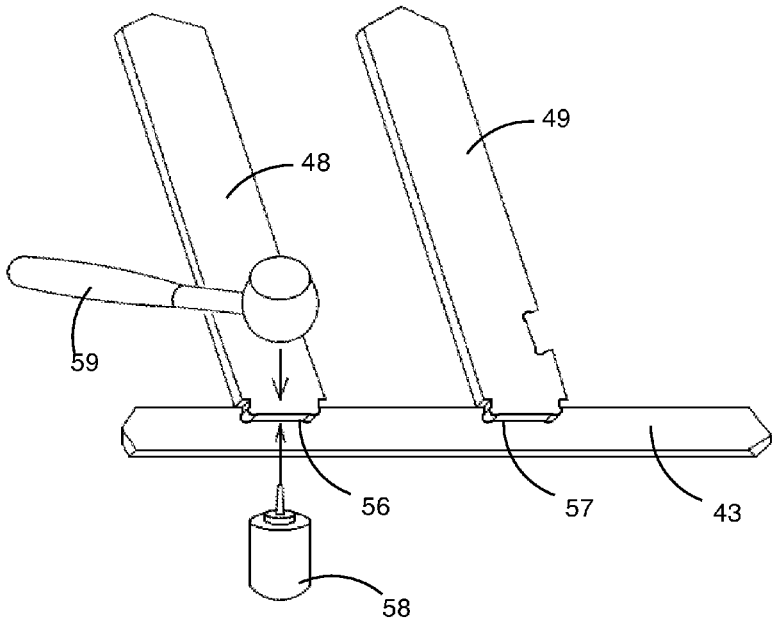
FIG. 4 is a perspective side view of a portion of a wall of a building being assembled in accordance with the principles of the present invention.

As shown in FIG. 4, each joint, such as joints 56 and 57 that are formed between members 43 and 48 and 43 and 49, respectively, and are secured by employing an adhesive, such as wood glue 58. Because of the tight tolerances used in manufacturing the various members, a mallet 59 is used to force the members 43, 48 and 49 together at the joints 56 and 57. Interestingly, while the glue eventually forms a substantially permanent attachment of the various components, because of the tight friction fit of the components, the assembly process can proceed while the glue continues to set.

Figure 5:
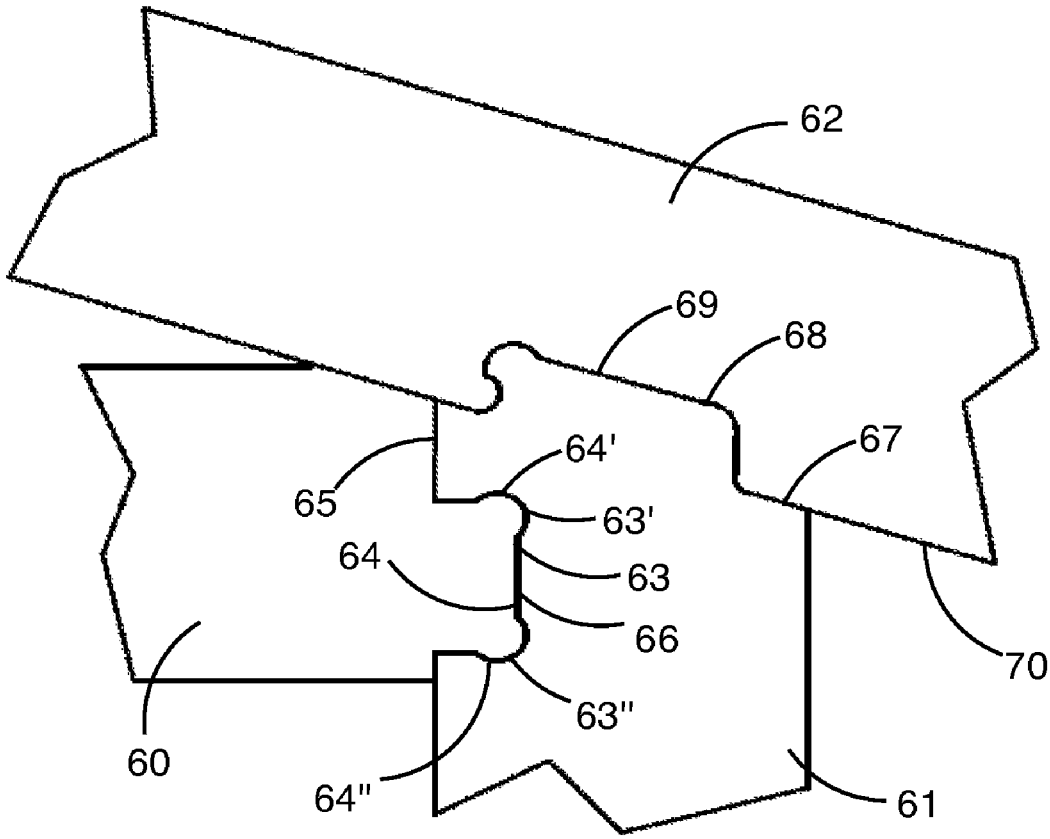
FIG. 5 is a side view of one joint assembly of a frame assembly of a building in accordance with the principles of the present invention.

Referring to FIG. 5, there is illustrated a close-up view of interlocking members 60, 61 and 62. The member 61 is provided with a puzzle-piece shaped recess 63 for receiving a similarly configured puzzle-piece shaped protrusion 64 formed on a proximal end 65 of the member 60. When joined, the resulting joint 66 is very strong because the protrusion 64 includes laterally extending protuberances 64' and 64" that fit within and are held by channels 63' and 63", respectively, formed in recess 63. Each member 60, 61 and 62 may be of similar dimension, such as wood beams having an approximately one inch by four inch thickness and width. Such wood commonly referred to as a 1×4 may actually be three quarters of an inch thick with a width of 3½ inches and of the desired length according to building specifications. Of course, other wood sizes may be employed according to the principles of the present invention. The end 67 of the member 61 is provided with a puzzle-piece shaped protrusion 68 that fits within a similarly sized and shaped puzzle-piece shaped recess 69 formed in a side 70 of member 62 where the two members 61 and 62 meet. Thus, the various joints of the present invention need not be only positioned where an end of one member meets with an adjoining end of another member. Likewise, as illustrated, the various joints of the present invention may be provided to attach two members, such as members 61 and 62 that have longitudinal axes that are not perpendicular to one another, but are oriented at some other angle. In addition, each member may have several joints depending on the configuration of the frame.

Figure 6A:
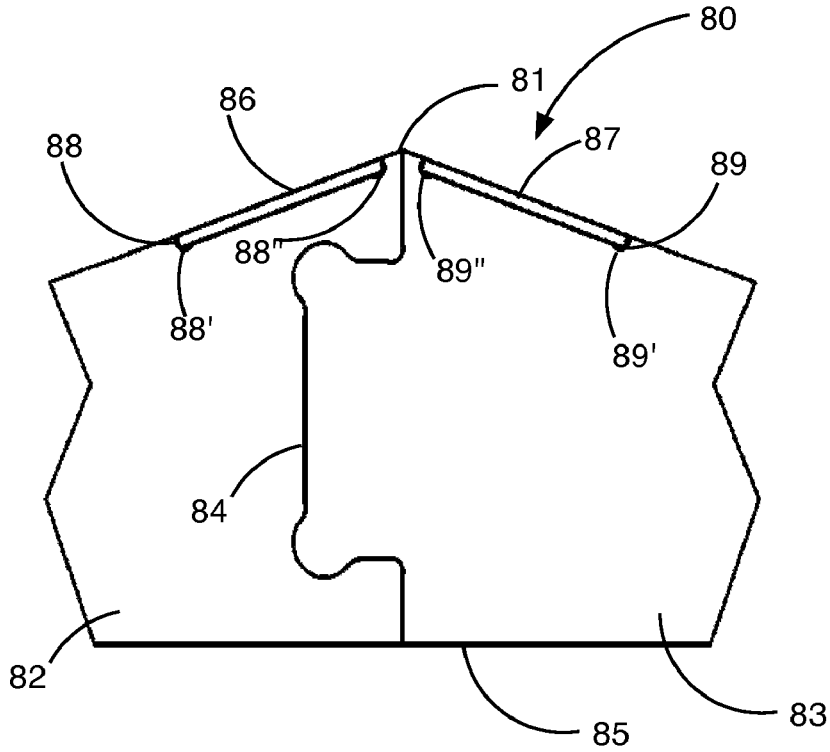
FIG. 6A is a front side view of a joint assembly of a truss assembly of a building in accordance with the principles of the present invention.
Figure 6B:
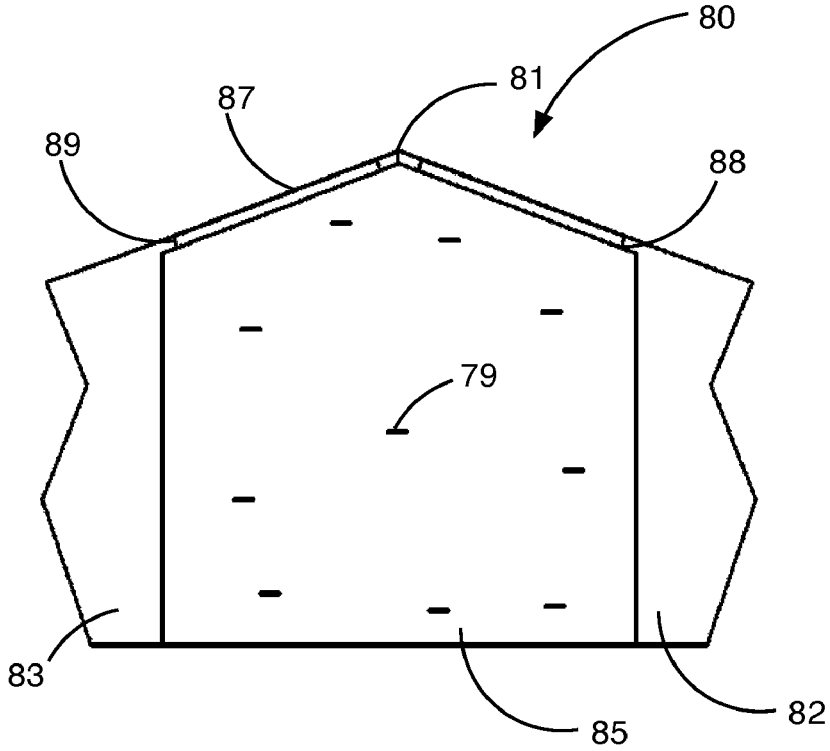
FIG. 6B is a back side view of the joint assembly illustrated in FIG. 6A.

FIGS. 6A and 6B illustrate a rafter or truss assembly 80 that forms part of a roof structure for a building according to the principles of the present invention. The truss assembly 80 is configured to provide a pitched roof having a peak 81. The truss assembly 80 is comprised of a pair of laterally extending truss members 82 and 83 that are joined proximate the midpoint of the peak 81. The resulting joint 84 lies substantially perpendicularly to the horizontal to provide maximum structural integrity such that vertical forces that may be experienced, as from the accumulation of snow on the roof, can be adequately supported. Overlapping support member 85 is attached, as by stapling with staples 79, nailing or screwing, to the back side of the members 82 and 83 to provide lateral support and added rigidity to the joint 84. Transversely extending rib members 86 and 87 are attached to the top edges of the members 82 and 83, respectively, and are provided to interconnect the truss 80 with an adjacent, spaced-apart truss as will be described herein. The top edges of the members 82 and 83 are provided with recesses 88 and 89 for receiving the rib members 86 and 87 so that the rib members are fully received within the truss members to provide a substantially flush top edge. This allows the roofing material, such as wood-based sheets to be flush mounted to the top edges of the truss assembly 80. Each recess 88 and 89 is provided with circular cut ends 88', 88", 89' and 89", respectively. Circle cutting the ends as illustrated at the corners of each recess provides structural strength to each member 82 and 83 so as to limit the possibility of the member 88 or 89 from fracturing at the corner of the recess that may be more likely to occur if the corners of the recesses 88 and 89 were to form a 90 degree angle or some other sharp angle where stress fractures are more likely to occur.

Figure 7:
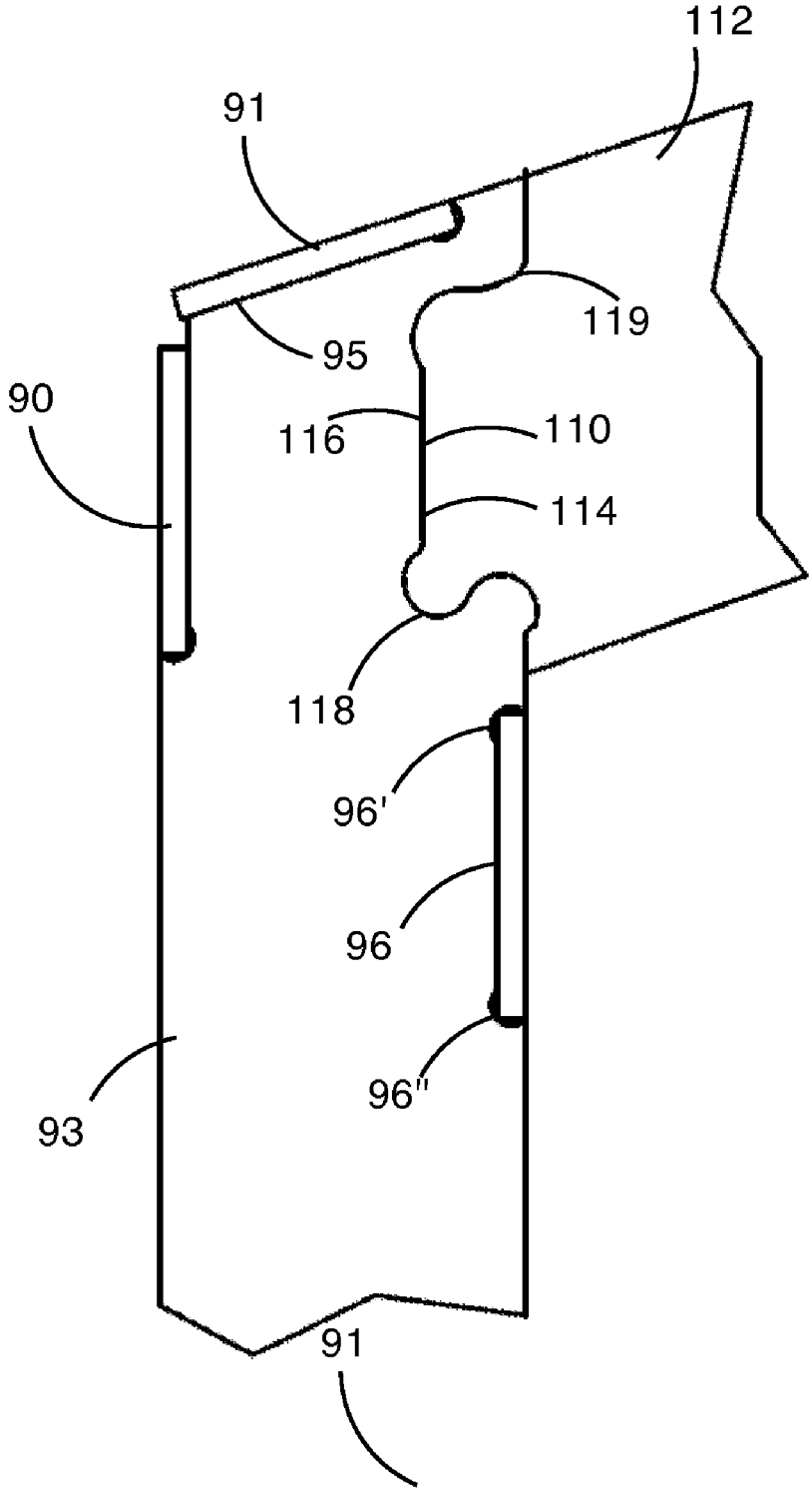
FIG. 7 is a front side view of another joint assembly of a building in accordance with the principles of the present invention.

As further illustrated in FIG. 7, each intersecting cross-member 90, 91 and 92 that intersects perpendicularly to a frame member 93 is fitted within a respective recess or cutout 94, 95 and 96 so as to make the cross-members 90, 91 and 92 essentially interlock with the frame member 93 and so that an exposed surface of each cross-member 90, 91 and 92 is substantially flush with the corresponding edge of the member 93. Each of the cross-members 90, 91 and 93 is stapled, nailed or screwed to the side of the member 93. In addition, as further shown, each recess or cutout 94, 95 and 96 has rounded corners, such as rounded corners 96' and 96" to prevent fracturing of the frame member 93 at the corners of the recess 96. FIG. 7 further illustrates a joint 110 formed between upright side wall frame member 93 and truss member 112. Again, a jigsaw-type puzzle piece interlocking joint is formed between the two members 93 and 112. The member 112 is provided with a male projection 114 for fitting within a female recess 116 formed in the upper side of the member 93. The lower portion of the joint 110 is provided with an "S" shaped contour to provide positive engagement between the members 93 and 112. Similarly, the upper portion of the joint 110 is provided with a curved shape in which the distal end 118 of the projection 114 is wider than a proximal end 119 of the protrusion to create the positively interlocked joint 110 between the two members 93 and 112.

Figure 8A:
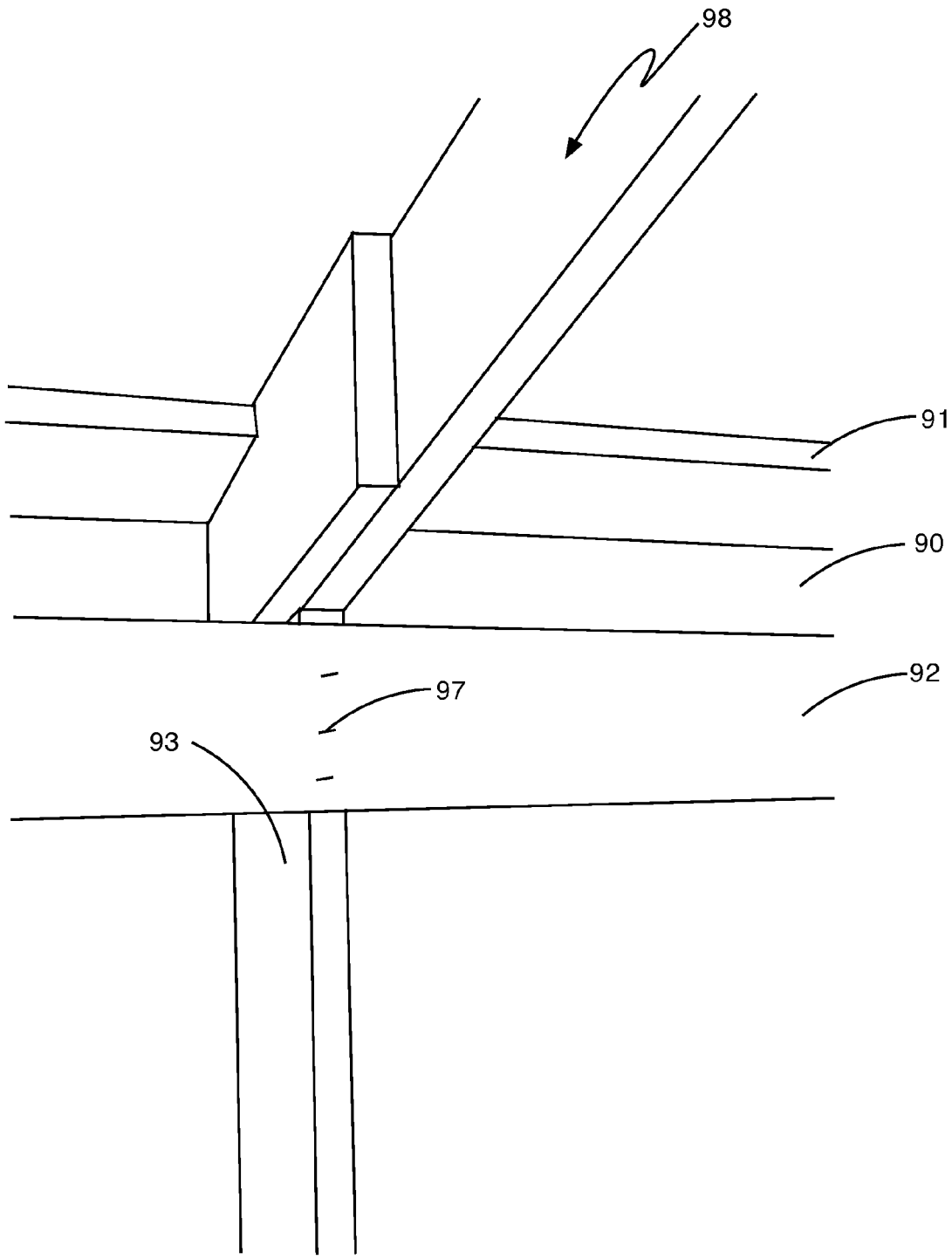
FIG. 8A is an interior perspective front side view of a joint assembly in accordance with the principles of the present invention.
Figure 8B:
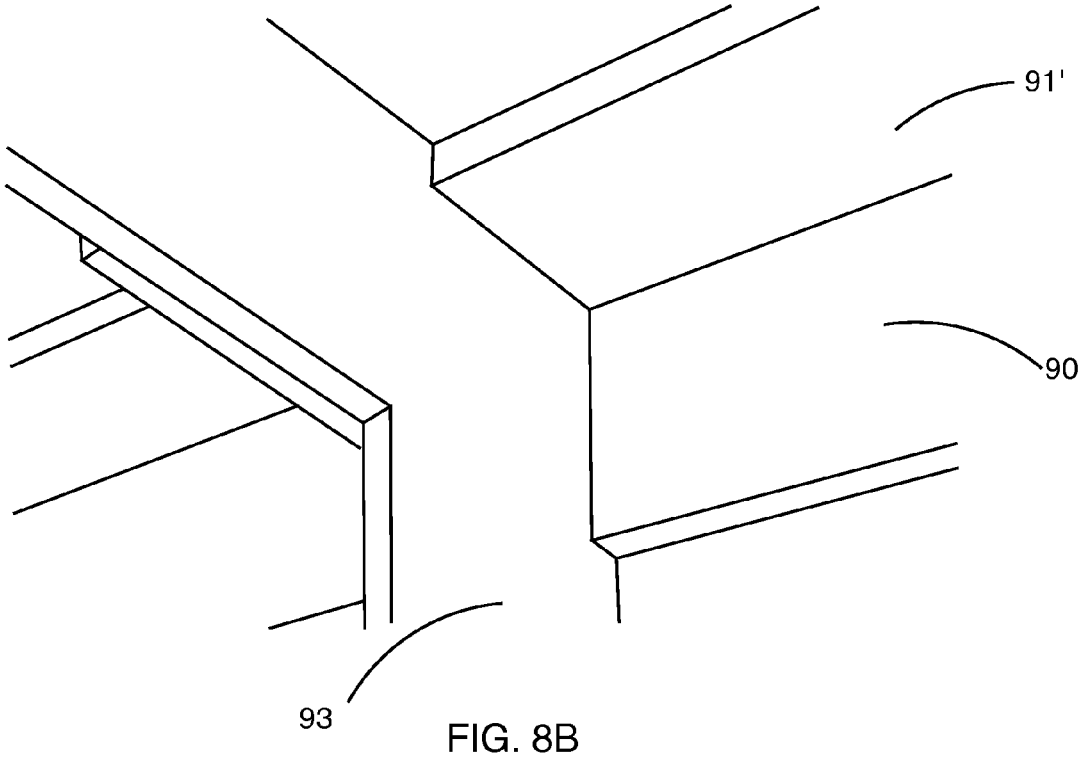
FIG. 8B is an interior perspective back side view of the joint assembly illustrated in FIG. 8A.
Figure 8C:
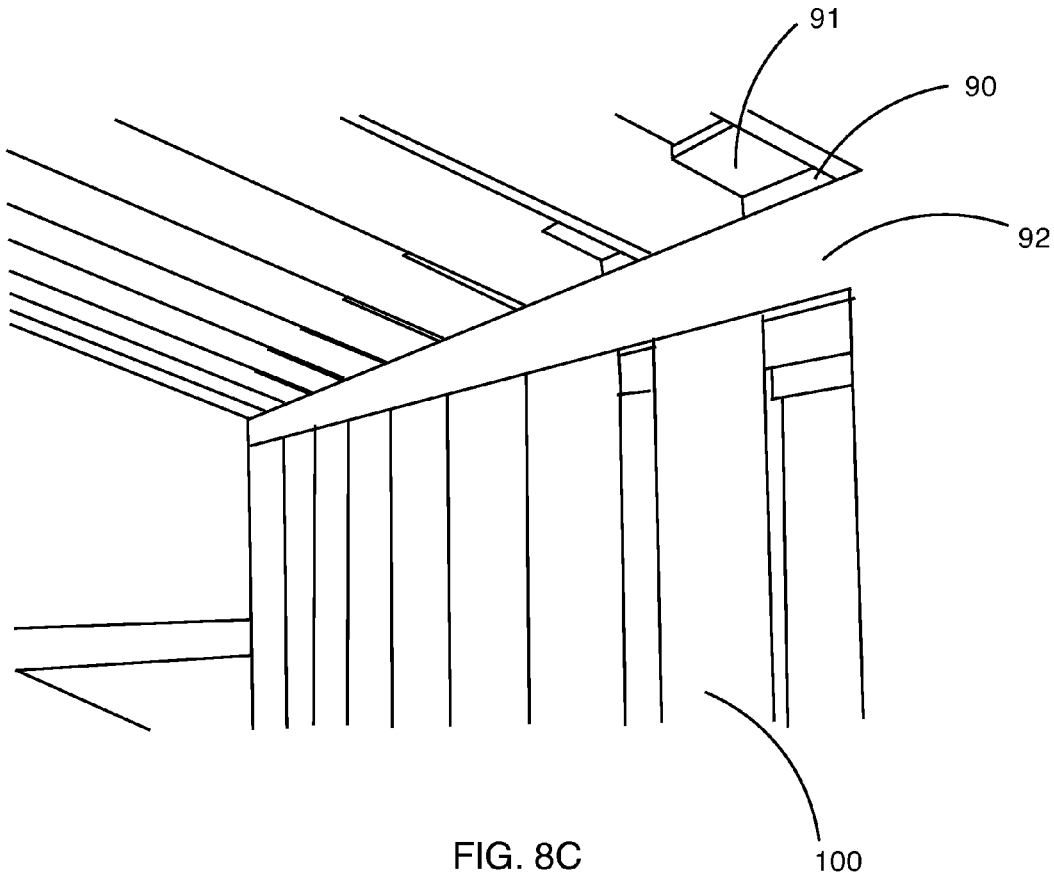
FIG. 8C is another interior perspective back side view of the joint assembly illustrated in FIG. 8B.
Figure 8D:
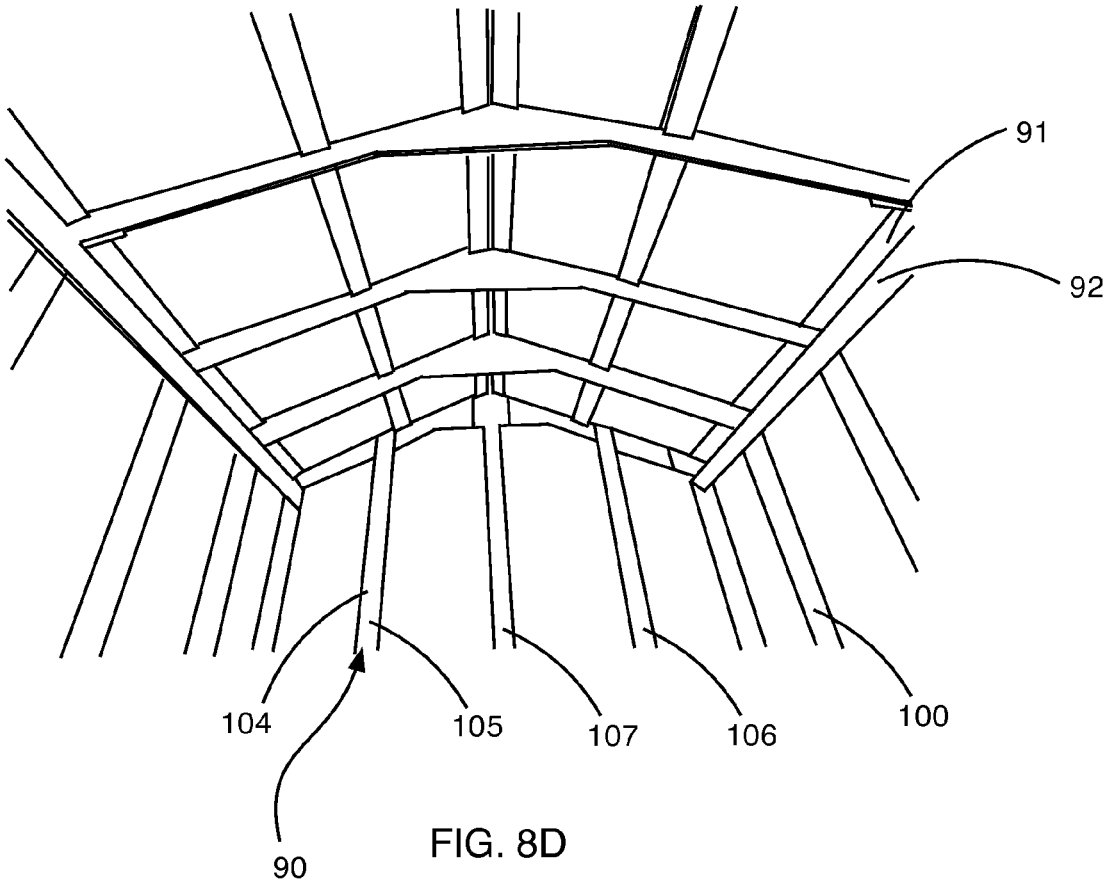
FIG. 8D is yet another interior perspective back side view of the joint assembly illustrated in FIG. 8B.

Once all of the individual frame subassemblies, such as subassembly 98 shown in FIG. 8A or the subassembly more fully shown in FIG. 3, have been assembled, as shown in FIG. 3, they are interconnected with cross-members 90, 91 and 92 in a manner similar to that depicted in FIG. 7. The cross-members 90, 91 and 92 may be attached to the frame member 93 with staples, screws, nails or brads 97 that are driven, as with a pneumatic nail gun, through the cross-members 90, 91 and 92 and into the frame member 93. This process is repeated for each subassembly and on both sides of the subassembly as illustrated in FIG. 8B. In FIG. 8B, only a top cross-member 91' and outside cross-member 90' are employed. As shown in FIGS. 8C and 8D, the individual frame subassemblies, such as subassembly 100 are equally spaced apart along the length of the structure and held in place with cross-members 90, 91 and 92 in what can be described in a rib-cage configuration. As further illustrated in FIG. 8D, the back wall subassembly 103 is configured similarly to the other subassemblies but is also provided with a plurality of vertical support members 104, 105 and 106 that are interconnected between the truss assembly 107 and the floor joist (not shown but previously illustrated and described). The vertical support members 104, 105 and 106 may be attached in a manner similar to the internal vertical members 35 and 38 illustrated in FIG. 3 or simply attached in an overlapping manner to the inside of the truss assembly 107 and floor member as illustrated.

Figure 8E:
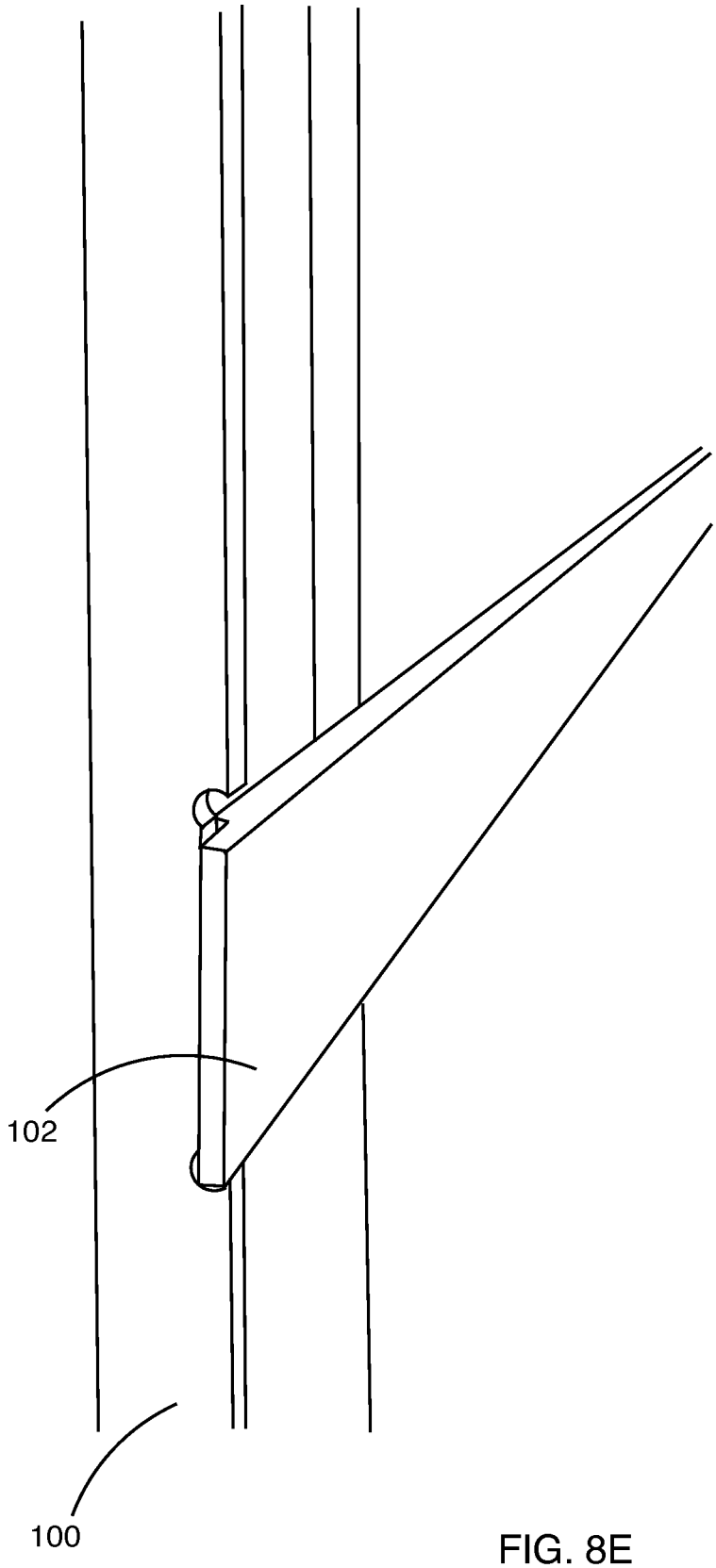
FIG. 8E is an interior perspective view of another joint assembly in accordance with the principles of the present invention.

As illustrated in FIG. 8E, other mid-position cross-members 102 may be provided along the sides of the structure to provide additional stability to the resulting structure. Again, such cross-members are recessed within the vertical side wall members 100 so that the cross-members 102 do not protrude from the surface of the subassemblies. This is so that each of the outer edges of the subassemblies provides a substantially linear outer edge for mounting an exterior wall panel to the outside surfaces of the various components. Thus, the cross-members 102 are flush mounted to the outside of the structure so that the wall panels can mount flush against the vertical wall members 100.

Figure 9A:
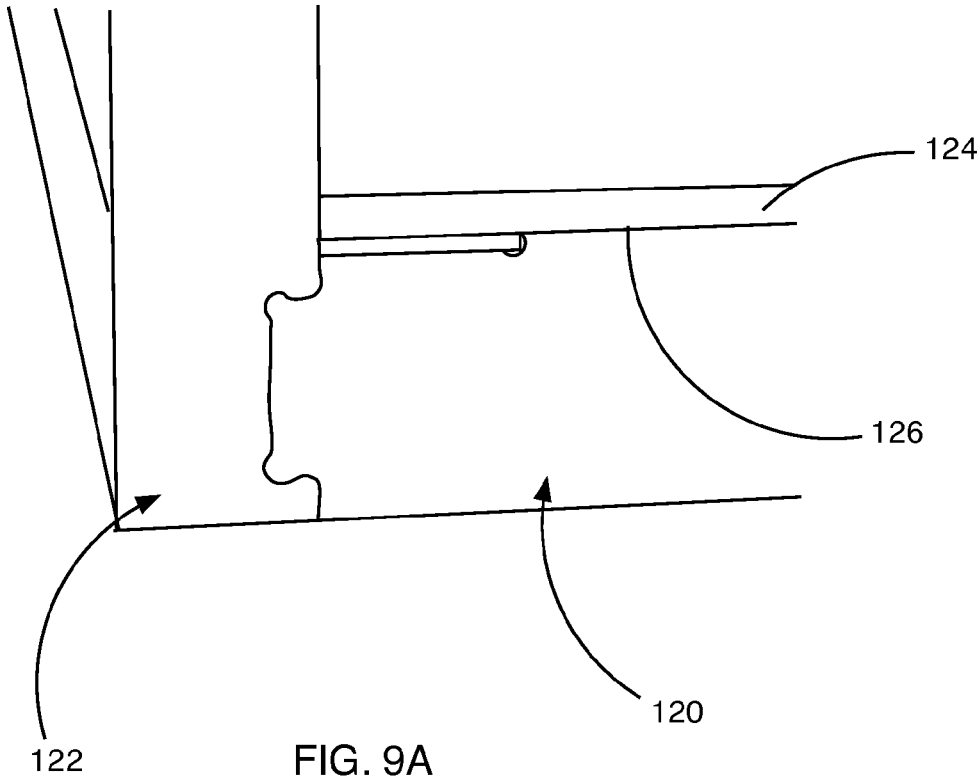
FIG. 9A is an exterior perspective side view of a corner joint assembly of a building in accordance with the principles of the present invention.
Figure 9B:
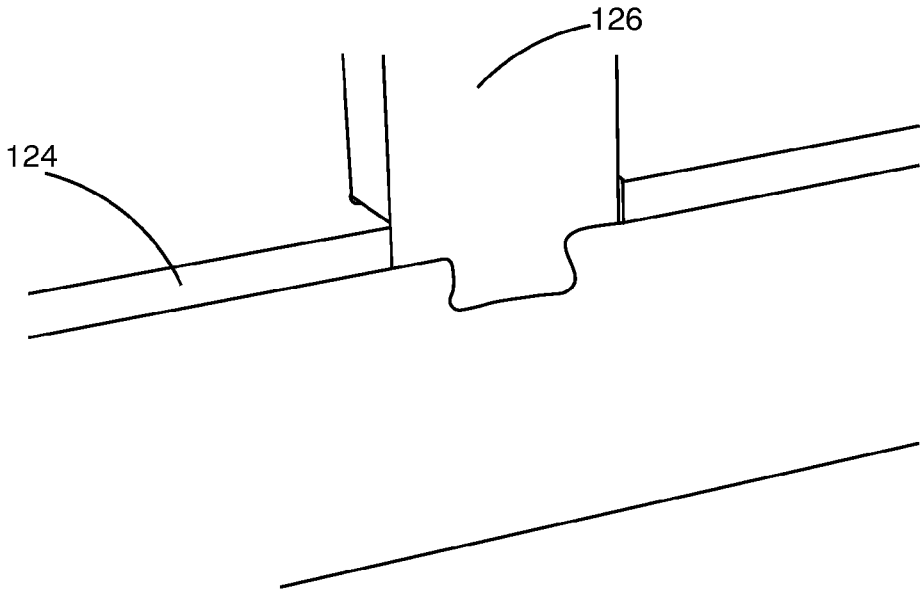
FIG. 9B is an exterior side view of a joint assembly of a building in accordance with the principles of the present invention.

As illustrated in FIG. 9A, the base or floor assembly 120 of the structure is comprised of the individual frame subassemblies, such as a front subassembly 122 that has been previously assembled and erected as described herein. A panel 124, such as a sheet of plywood or wafer board, is attached to the inside top edge 126 of each frame subassembly 122, with the floor being formed within the interior space defined by the individual frame subassemblies. Depending on the size of the floor assembly 120, a plurality of floor panels 124 may be required to cover the entire interior surface that constitutes the floor of the structure. As further shown in FIG. 9B, wherever the panels 124 intersect an upright frame member 128, the panels 124 are pre-notched to fit around the frame member 128. This provides additional structural rigidity to the resulting-building.

Figure 10A:
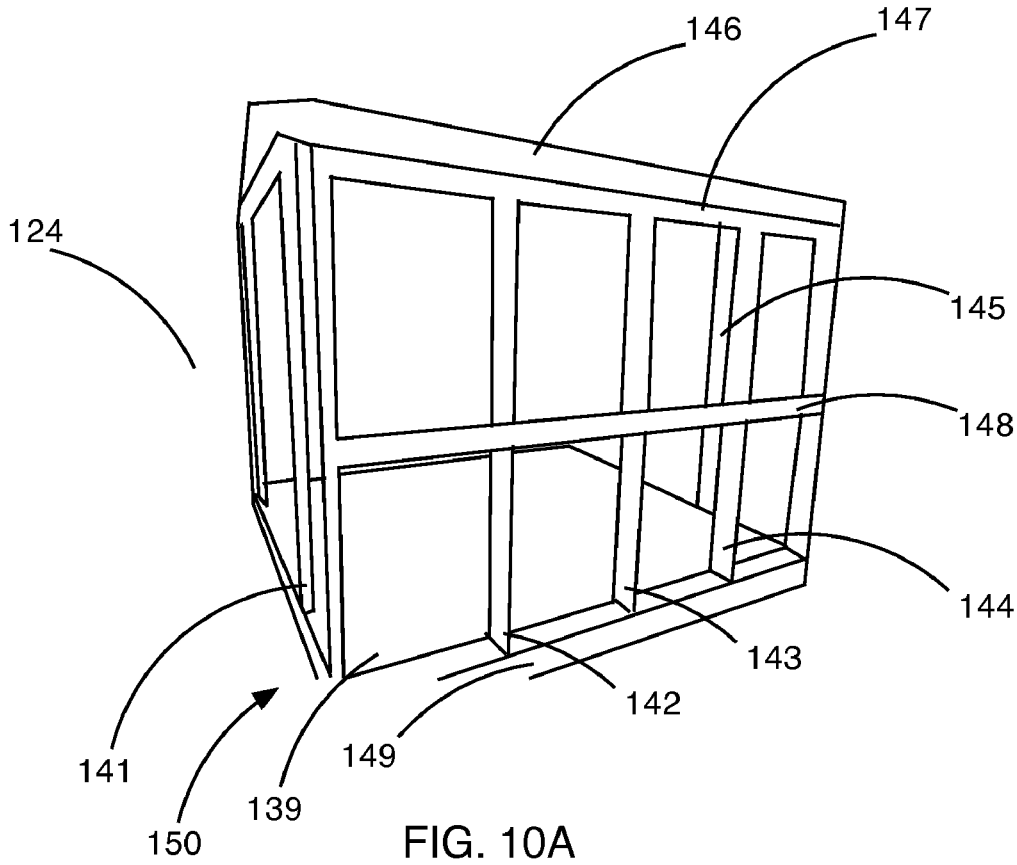
FIG. 10A is a perspective side view of the frame of a building constructed in accordance with the principles of the present invention.
Figure 10B:
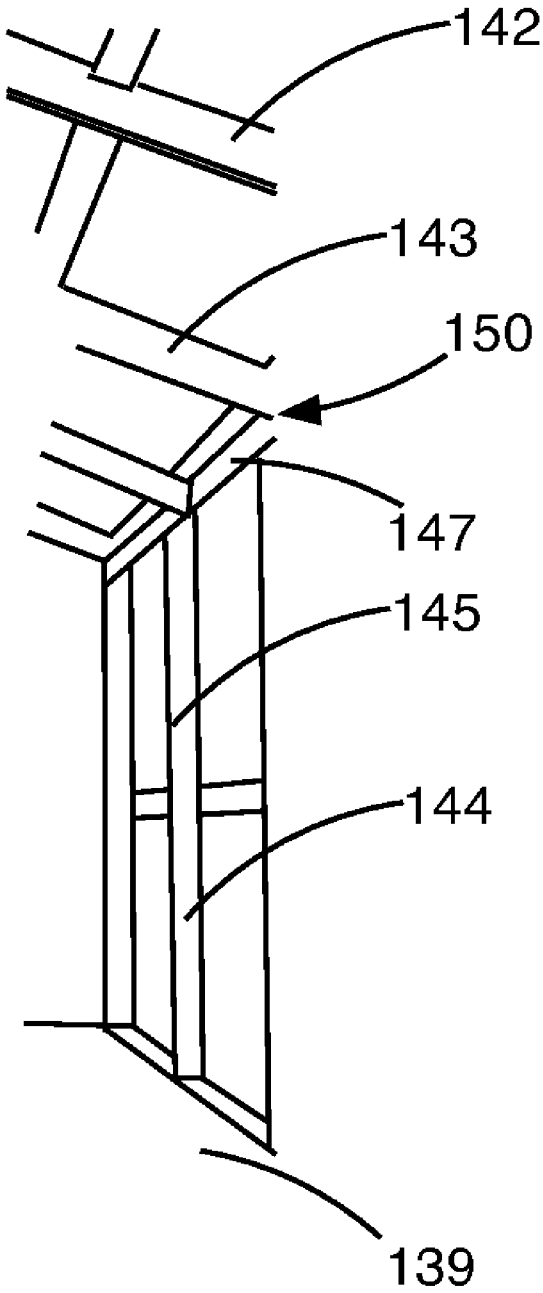
FIG. 10B is a perspective interior view of the frame of a building constructed in accordance with the principles of the present invention.

Once the basic frame assembly, generally indicated at 150, of the structure is assembled, as shown in FIGS. 10A and 10B, the completed frame assembly is strong and can support significant weight even without any wall or roof panels attached thereto. In this embodiment, the internal frame assembly is comprised of a front frame assembly 141, a plurality of intermediate frame assemblies 142, 143 and 144, a back wall frame assembly 145, various supporting and interconnecting cross-members such as cross-members 146, 147, 148 and 149. A floor 139 is attached over the floor joists (not visible of each frame assembly 141, 142, 143, 144 and 145. This strength is due in large part to the fact that the various interlocking members do not rely on fasteners, such as nails, to provide structural integrity. Rather it is the interlocking members themselves and their engagement that provides the strength of the various joints. It should also be noted that because there are fewer overlapping members forming the structure, as compared to conventional wood frame construction techniques, the finished structure is comparatively lighter than a similarly sized structure built using such conventional construction techniques.

Figure 11A:
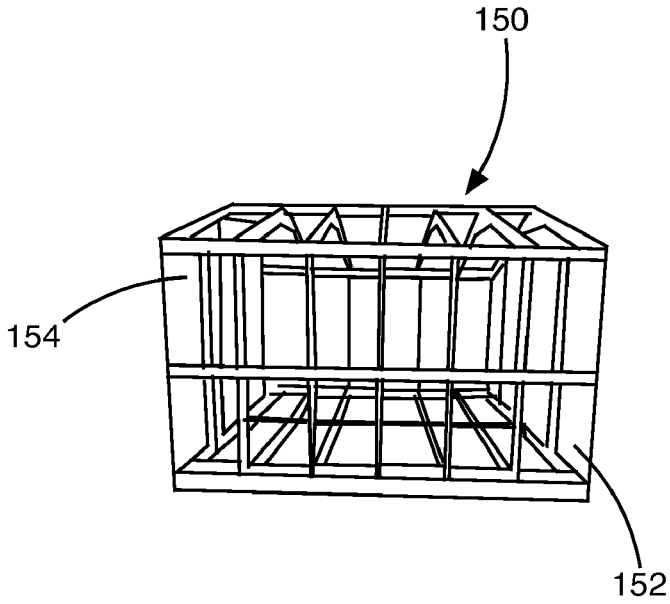
FIG. 11A is a perspective side view of the frame of a building constructed in accordance with the principles of the present invention with exterior side wall panels attached thereto.
Figure 11B:
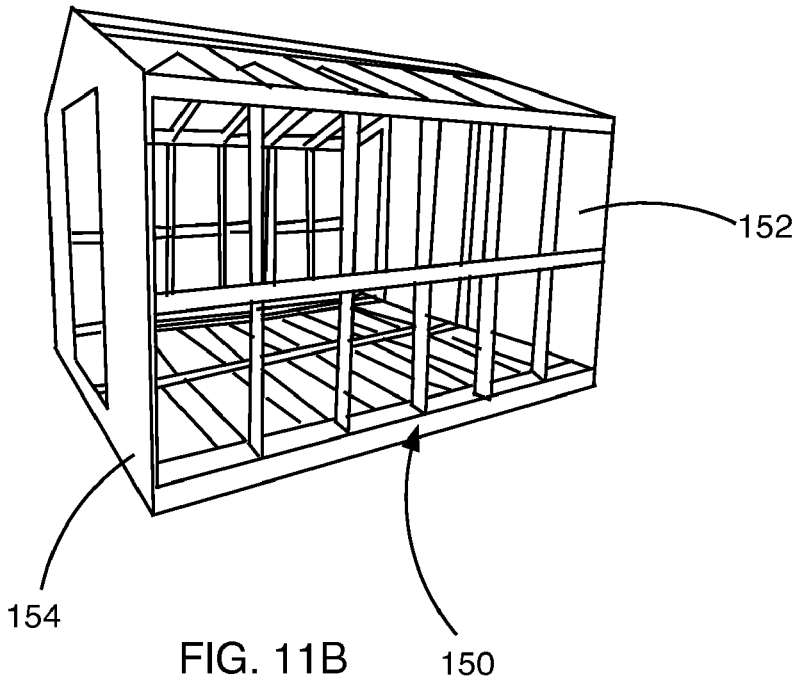
FIG. 11B is a perspective side view of the frame of the building illustrated in FIG. 11A.
Figure 12A:
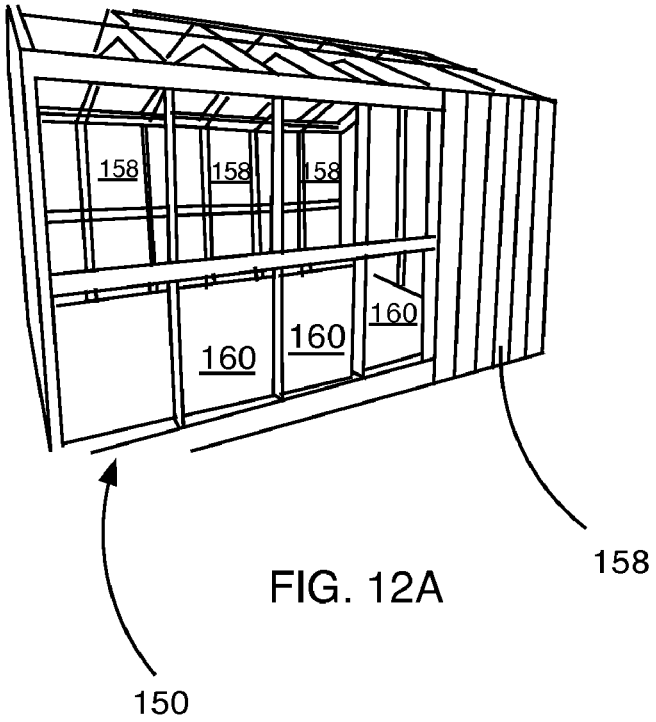
FIG. 12A is a perspective side view of the frame of a building constructed in accordance with the principles of the present invention with additional exterior side wall panels attached thereto.
Figure 12B:
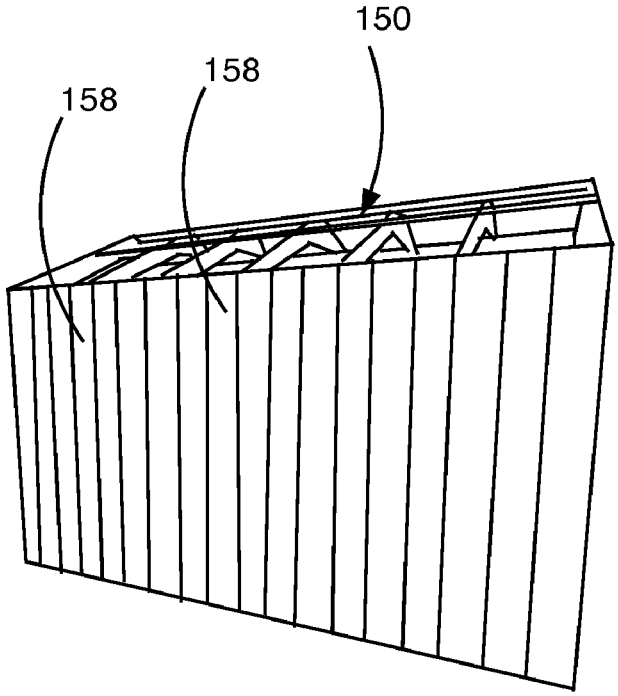
FIG. 12B is a perspective side view of the frame of a building constructed in accordance with the principles of the present invention with additional exterior side wall panels attached thereto.

As illustrated in FIGS. 11A and 11B, when the frame assembly 150 is completed, panels 152 and 154 that form the end walls are attached to the frame assembly 150. They may be nailed, stapled, screwed or otherwise attached to the frame assembly 150 by other means known in the art. Once the end walls are completed, as shown in FIGS. 12A and 12B, the side wall panels 158 are attached to the frame assembly 150 to form the side walls of the structure. Again, such side wall panels 158 may be attached to the frame assembly 150 by nailing, stapling, screwing or other means known in the art. The floor panels 160 are also attached. It should be noted that once the frame assembly 150 is completed, that the end walls, side walls and floor can be attached in any order as desired without departing from the spirit and scope of the present invention. Moreover, while certain construction steps have been described herein in a particular order, such order may not necessarily be required to assemble a structure using components according to the present invention. Such described order is for illustration purposes only and not intended to limit the scope of the present invention.

Figure 13A:
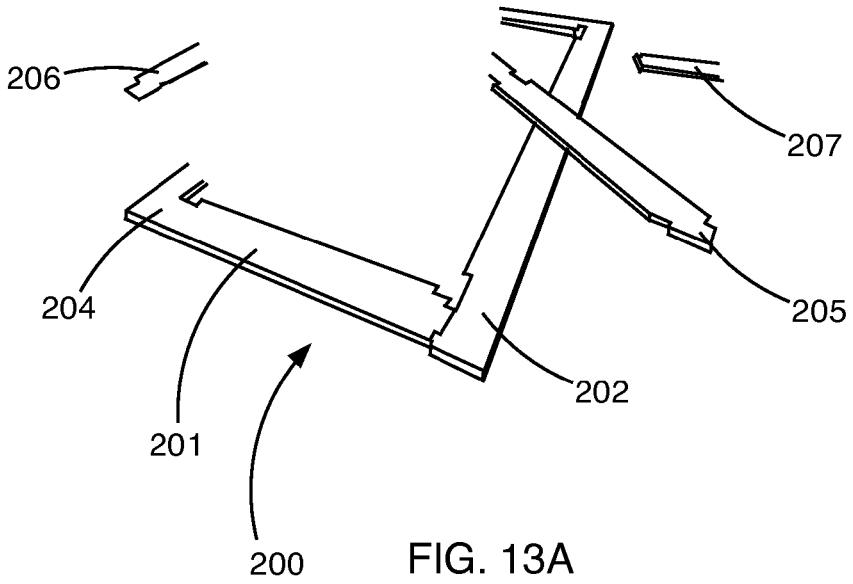
FIG. 13A is a perspective side view of a partially assembled door frame in accordance with the principles of the present invention.
Figure 13B:
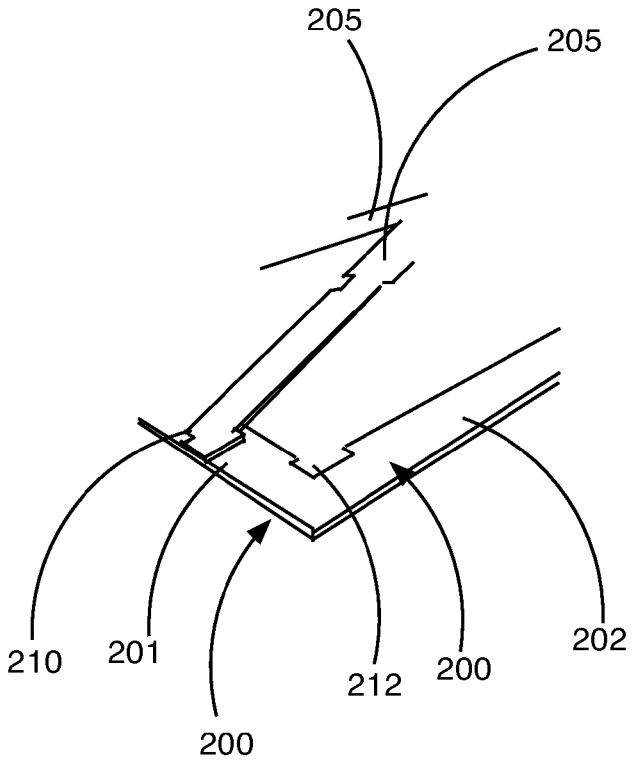
FIG. 13B is a perspective side view of the partially assembled door frame illustrated in FIG. 13A.
Figure 14:
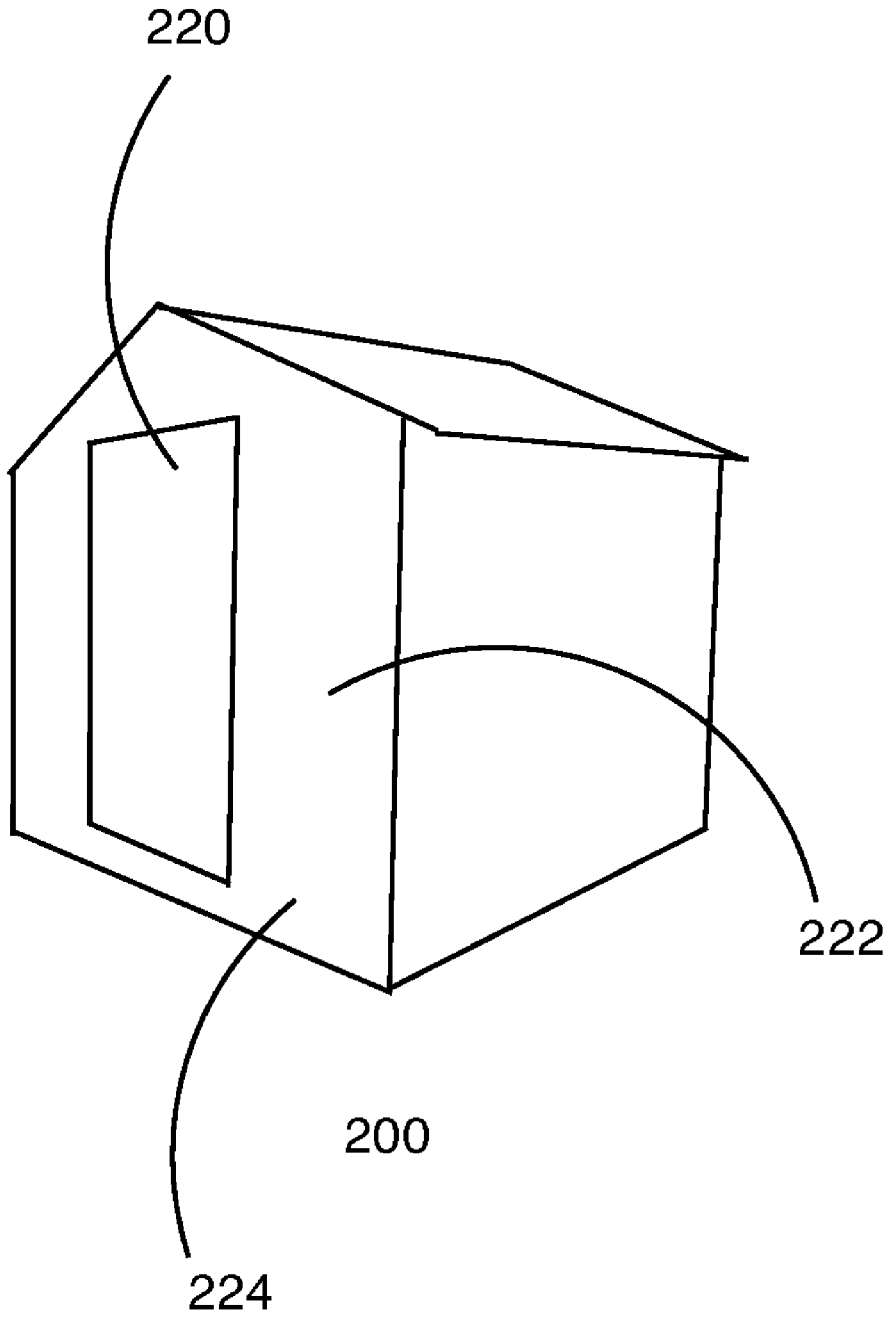
FIG. 14 is a perspective side view of a completed building constructed in accordance with the principles of the present invention.

Once the various side walls have been attached, the door assembly can be constructed as shown in FIGS. 13A and 13B. The door assembly, generally indicated at 200 is comprised of four perimeter members 201-204 and cross-members 205-207. The perimeter members 201-204 are provided within interlocking puzzle-piece joints that are joined together in a manner similar to the assembly of the frame members previously described herein. The perimeter members 201-204 form a rectangular frame to which cross-members 205-207 are attached. The cross-members are provided with puzzle-piece shaped ends 210 that engage and interlock with receiving puzzle-piece shaped recesses 212 formed in the interior corners of the rectangular frame as a result of the combination of the perimeter members 201-204. As further shown in FIG. 14, a door panel 220 is mounted to the rectangular frame and the frame is hingedly attached to the structure so that the panel 220 is substantially flush with the exterior surface 222 of the front wall 224. Various embodiments of door handles, latches and/or locking mechanisms may be added to the door as is conventional for such structures.

Figure 15:
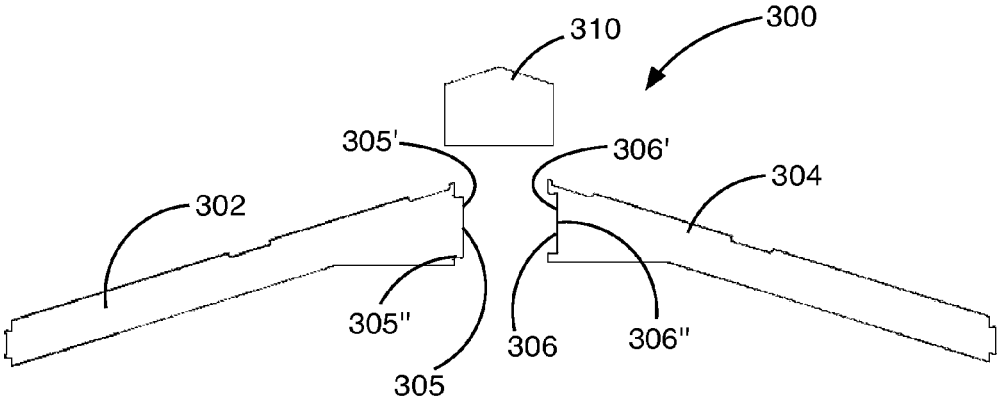
FIG. 15 is a front side view of a truss frame assembly for constructing a building in accordance with the principles of the present invention.
Figure 16:
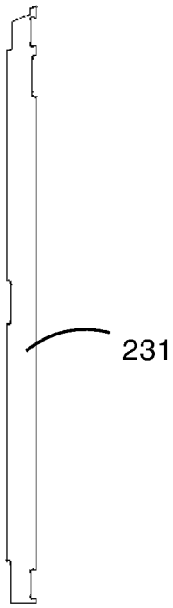
FIG. 16 is a side view of a side wall frame member for constructing a building in accordance with the principles of the present invention.

As illustrated in FIG. 15, a truss assembly, generally indicated at 300, is comprised of a pair of upwardly angled truss members 302 and 304. The truss members 302 and 304 have a similar but opposite configuration with the exception of the proximal ends 305 and 306 that are configured to form an interlocking joint as previously described herein. Specifically, the end 305 is provided with a puzzle-piece shaped protrusion that is wider proximate a proximate end 305' thereof than at a distal end 305". Each of the corners of the protrusion 305 is rounded. Similarly but oppositely configured, the truss member 304 is provided with a puzzle-piece shaped recess 306 that has rounded corners and that is wider at a distal end 306" than a distal end 306'. This allows the truss members 302 and 304 to mate together to form an A shaped truss 300. Each truss member 302 and 304 is provided with a triangularly shaped proximal end 305 and 306, respectively to provide a wider joint between the two truss members 302 and 304. The top edge of the truss members are upwardly angled at the desired pitch of a roof to be constructed with the truss members 302 and 304. Virtually any desired pitch can be accommodated. The bottom edge of each truss member 302 and 304 is similarly angled so as to be generally parallel to the top edge over a majority of the length of each truss member 302 and 304. Proximate to the area of the joint between the two truss members 302 and 304, the truss members widen such that a bottom edge thereof is substantially horizontal. This allows the width of the joint to be sufficient without significantly diminishing the ceiling height below the truss 300. Once the two truss members 302 and 304 are joined together, an overplate 310 is attached over the resulting joint so as to add additional lateral strength and stability to the joint and further prevent the joint from disconnecting. The overplate 310 can be attached to the truss 300 by any means known in the art. The overplate 310 has a five-sided configuration to substantially match the shape of the truss proximate the joint.

Figure 17:
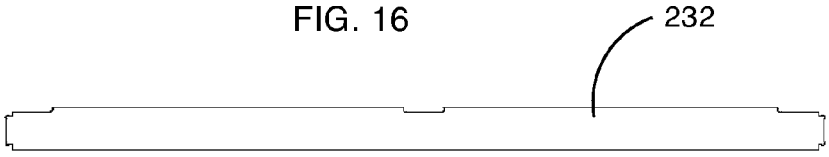
FIG. 17 is a side view of a floor joist frame member for constructing a building in accordance with the principles of the present invention.

FIGS. 6 and 17 further illustrate plan views of upright and bottom frame members 231 and 232, respectively, having configurations similar to the counter-part frame members previously illustrated and described herein.

Each joint is configured to interlock adjacent members in a manner that provides significant longitudinal strength to resist forces that may be placed on the adjacent members along their respective lengths. While there is some lateral strength in such joints, structural strength in lateral directions to the adjacent members is provided by members that are oriented perpendicularly to the adjacent members and/or attachment of an exterior panel, as is the case with the door assembly described herein.

It will be apparent to those skilled in the art that some other configurations of a building structure may be constructed using the method and structures set forth in the foregoing description without departing from the inventive concepts herein. For example, the building may be a larger building, such as a modular or mobile home or a smaller structure, such as a dog house. Thus, the methods and structures set forth in the present invention can be scaled to match the size of the structure to be built. For example, the exact contour of the puzzle-piece joints can be modified into virtually any shape or size as may be desired. Thus, while there have been described various embodiments of the present invention, those skilled in the art will recognize that other and further changes and modifications may be made thereto without department from the spirit of the invention, and it is intended to claim all such changes and modifications that fall within the true scope of the invention. It is also understood that, as used herein and in the appended claims, the term "puzzle-piece" refers to an interlocking configuration in which a protruding portion of one part fits within and is held in place by a recessed part of an adjoining part. Additionally, the singular forms "a," "an," and "the" include plural reference, unless the context clearly dictates otherwise.

Unless defined otherwise, all technical and scientific terms used herein have the same meanings as commonly understood by one of ordinary skill in the art to which this invention belongs. While various methods and structures of the present invention are described herein, any methods or structures similar or equivalent to those described herein may be used in the practice or testing of the present invention. All references cited herein are incorporated by reference in their entirety and for all purposes. In addition, while the foregoing advantages of the present invention are manifested in the illustrated embodiments of the invention, a variety of changes can be made to the configuration, design and construction of the invention to achieve those advantages including combinations of components of the various embodiments. Hence, reference herein to specific details of the structure and function of the present invention is by way of example only and not by way of limitation.

What is claimed is:

1. A building structure, comprising:

a plurality of wood frame assemblies joined together to form an internal frame structure for a building, each of said plurality of frame assemblies comprising a truss, a pair of vertical wall members and a floor joist, said truss attached to respective top ends of said pair of vertical wall members at each end of said truss with an interlocking joint in which a face of the truss and the faces of the pair of vertical wall members are in substantially the same plane, and each bottom end of said pair of vertical wall members are attached to respective ends of said floor joist with interlocking joints each of said interlocking joints comprised of a puzzle-piece shaped recess in a first adjoining member and a corresponding puzzle-piece shape protrusion in a second adjoining member, the puzzle-piece shaped recess having a width at its narrowest point that is significantly greater than a depth of the recess for tightly receiving said protrusion;

said truss comprised of first planar member and second planar member, each having a thickness that is significantly less than a height of the truss, said first and second members angled relative to one another to form a pitch of a roof supported by said truss, said first and second members jointed together with a truss joint proximate a peak of the roof comprised of a puzzle-piece shaped recess in the first member and a corresponding puzzle-piece shape protrusion in the second member, the puzzle-piece shaped recess having a width at its narrowest point that is significantly greater than a depth of the recess for tightly receiving said protrusion therein, a plurality of cross-members interconnecting said plurality of frame assemblies in a spaced-apart manner;

at least one floor panel attached to said plurality of frame assemblies and positioned on top of each floor joist of said plurality of frame assemblies; and a plurality of exterior wall panels attached to an exterior of said internal frame structure; wherein said interlocking joint further comprises rounded distal end corners and rounded proximal end corners to form a puzzle-piece shape.

2. The building structure of claim 1, wherein said plurality of frame assemblies, exterior wall panels and cross-members and at least one floor panel are configured to form a storage shed.

3. The building structure of claim 1, wherein said plurality of frame assemblies comprises a front wall frame assembly, a back wall frame assembly and a plurality of intermediate frame assemblies.

4. The building structure of claim 3, wherein said front wall assembly is further comprised of a plurality of interior vertical frame members connected between said floor joist and said truss with interlocking joints formed therebetween.

5. The building structure of claim 4, wherein said front wall assembly is further comprised of at least one upper cross-member connected between two of said plurality of interior vertical frame members and forming an upper door frame member.

6. The building structure of claim 5, further comprising at least one vertical door frame support member connected between said upper door frame member and said truss with interlocking joints formed thereinbetween.

7. The building structure of claim 1, wherein each of said interlocking joints are attached with an adhesive.

8. The building structure of claim 7, further comprising a plurality of overplates attached to said plurality of frame members over said interlocking joints.

9. The building structure of claim 3, wherein said back wall assembly is further comprised of a plurality of interior vertical frame members connected between said floor joist and said truss with interlocking joints formed therebetween.

10. A truss assembly for a building structure, comprising:

a pair of upwardly angled planar wood truss members, said truss members having a similar but opposite configuration, and having proximal ends that are configured to form an interlocking joint, one of said pair of upwardly angled truss members having a puzzle-piece shaped protrusion that is wider proximate a proximate end thereof than at a distal end, and the other of said pair of upwardly angled truss members having a corresponding puzzle-piece shaped recess that is wider proximate a distal end thereof than at a proximal end for tightly receiving said protrusion to form an interlocking joint between said pair of upwardly angled truss members, the pair or truss members being in planar alignment with one another and defining the peak of a roof to be supported by the truss members proximate the interlocking joint;

said puzzle-piece shaped protrusion having a left side defining a first rounded laterally extending portion and a right side defining a second rounded laterally extending portion extending opposite said first portion, said first and second rounded laterally extending portions being spaced by a substantially linear edge extending between said first and second rounded portions, wherein a height of said protrusion is significantly less than a distance between said first rounded laterally extending portion and said second rounded laterally extending portion and wherein said corresponding puzzle-piece shaped recess substantially matches the puzzle-piece shaped protrusion in contour and size.

11. The truss assembly of claim 10, wherein each of said puzzle-piece shape protrusion and recess has rounded corners.

12. The truss assembly of claim 10, wherein said pair of upwardly angle truss members has and "A" shaped configuration.

13. The truss assembly of claim 12, wherein said pair of truss members each have a triangularly shaped proximal end to provide a wider joint between the pair of truss members.

14. The truss assembly of claim 13, wherein a top edge of each of said pair of truss members is upwardly angled at a desired pitch of a roof to be constructed with the pair of truss members.

15. The truss assembly of claim 14, wherein a bottom edge of each of said pair of truss members is angled similarly to said top edge so as to be generally parallel to the top edge over a majority of the length of each of said pair of truss members.

16. The truss assembly of claim 15, wherein proximate to an area of the interlocking joint between the pair of two truss members, the pair of truss members widen such that the bottom edges thereof are substantially horizontal.

17. The truss assembly of claim 16, further comprising an overplate attached over the interlocking joint so as to add additional lateral strength and stability to the joint and further prevent the joint from disconnecting.

* * * * *